US005577629A

United States Patent [19]

Rosler

[11] Patent Number: 5,577,629

[45] Date of Patent: Nov. 26, 1996

[54] PACKAGE BOX

[75] Inventor: Peter Rösler, Wangen, Germany

[73] Assignee: Rose-Plastic GmbH, Hergensweiler, Germany

[21] Appl. No.: 518,410

[22] Filed: Aug. 23, 1995

[30] Foreign Application Priority Data

Aug. 31, 1994 [DE] Germany ..... 9414118 U

[51] Int. Cl.[6] ..... B65D 43/00

[52] U.S. Cl. ..... 220/525; 220/346

[58] Field of Search ..... 220/525, 526, 220/555, 346; 206/1.5, 214, 816

[56] References Cited

U.S. PATENT DOCUMENTS

| | | | |
|---|---|---|---|
| 2,105,424 | 1/1938 | Kahn | 206/214 X |
| 3,009,187 | 11/1961 | Barba et al. | 220/525 X |
| 3, 651,979 | 3/1972 | Severson | 220/346 |
| 3,703,955 | 11/1972 | Inacker | 220/555 X |
| 3,960,270 | 6/1976 | May | 220/346 X |
| 5,129,538 | 7/1992 | Bennett | 220/346 |
| 5,242,076 | 9/1993 | Gibilisco | 220/525 |
| 5,263,576 | 11/1993 | Boreen et al. | 220/346 X |
| 5,415,315 | 5/1995 | Ramirez | 220/346 |

*Primary Examiner*—Steven M. Pollard
*Attorney, Agent, or Firm*—Anderson, Kill & Olick P.C.

[57] ABSTRACT

A package box for flat objects having relatively small dimension and including a parallelepiped-shape main part with a separation wall, which extends in a longitudinal middle plane of the box, and with a plurality of transverse separation walls, and a closing cover, in which box the upper edge of the longitudinally extending separation wall has at least one rib equally spaced from both end walls and having a height not exceeding the thickness of the cover, and the cover has in its longitudinal middle plane at least one slot corresponding to the rib for receiving the rib in the closed condition of the box.

7 Claims, 2 Drawing Sheets

PACKAGE BOX

BACKGROUND OF THE INVENTION

The invention relates to a package box formed of a plastic material for flat objects having relatively small dimensions and including a box main part having a shape of a rectangular parallelepiped formed of a bottom, two longitudinally extending side walls and two transversely extending end walls projecting upward from the bottom and defining an upper box opening. The main part has a longitudinally extending separation wall projecting upward from the bottom and located in a longitudinal middle plane of the box along an entire length of the box, and a plurality of transverse separation walls. The height of the transverse separation walls and the end walls is smaller than the height of the side walls. The box further includes a cover for closing the box opening displaceable in a longitudinal direction of the box and having an inner surface lying, in a closed condition of the box, on upper edges of the separation and end walls and on guide beads provided on the longitudinally extending side walls, and an outer surface located beneath a plane defined by the upper edges of the longitudinally extending side walls.

Such boxes can have different dimensions and include means for preventing the cover from unintended displacement in the closed position of the package box.

In some of the boxes, one of the end walls has the same height as the side walls while the other of the end walls has a smaller height equal to the height of the separation walls, so that the cover can be displaced only in one direction. In other boxes, both end walls have a height equal to that of the separation walls, so that the cover can be displaced in both directions.

The above-described box should generally be so formed that the objects to be stored, e.g., cutting inserts, can be placed in cells formed by the separation walls by an automatized process, with the box being closed likewise by an automatized process in which advantageously the cover is placed conveniently from above. Such placement of the cover becomes complicated when not only the side walls of the box but also one of the end walls of the box has a height exceeding that of the separation walls, because the placement would then require another reference point in addition to those associated with the side walls. Further, the automatized placement of the cover requires that the upper edge region of the side walls be somewhat yieldable so that the cover is able to slide along the side steps which hold it at a proper level. However, the one end wall stiffens the side walls in the upper end region, so that in the vicinity of this end wall, the placement of the cover from above cannot be always effected perfectly and, therefore, complete closing of the box cannot be insured.

Another drawback of an end wall having the height equal to that of the side walls consists in that for removal from the box objects, which are located further away from this end wall, the cover should necessarily be moved in the opening direction a longer distance so that the cover forms a longer lever that, under operational conditions at which, e.g., the cutting inserts are handled, can lead to overturning of the box and, thus, to the loss or the damage of the objects.

The above-described boxes have to meet another requirement, namely, to insure that no unintended displacement of the cover in a longitudinal direction takes place. This can be insured by providing, on an inner surface of the cover, a hump which would abut the inner surface of the end wall and which could, possibly, define the closing direction, or by providing for sidewise pressure on the basis of the selected material of the box, e.g., polystyrol, so that a hump or the like would not be needed. However, these methods of retaining the cover are not reliable and can result in an unintended displacement of the cover and a partial opening of the boxes during transportation, or in such behavior of the boxes by themselves, with a possibility of the objects falling out from cells located adjacent to the end wall.

Accordingly, the object of the invention is a package box of the above-described type, in which the cover can be reliably brought in the closing position of the box by an automatized process and reliably retained in the closing position.

Another object of the invention is a package box in which the cover can be displaced in both opposite longitudinal directions above the end walls slightly more than a half of its overall length, so that the cover would cover cells still containing the objects.

SUMMARY OF THE INVENTION

This and other objects of the invention, which become apparent hereinafter, are achieved by providing a box of the above-described type in which the upper edge of the longitudinally extending separation wall has at least one rib equally spaced from both end walls and having a height not exceeding a thickness of the cover, and the cover has in a longitudinal middle plane thereof at least one slot corresponding to the rib for receiving the rib in the closed condition of the box.

The rib provided on the upper edge of the longitudinally extending separation wall and the slot for receiving the rib provided in the cover insure that the cover, which is placed from above, is brought precisely into its closing position. Providing the rib with inclined end edges facilitate the placement of the cover. The rib not only insures bringing of the cover precisely in its closed position but also prevents the cover from unintended displacement due to the engagement of the rib in the cover slot.

Due to the arrangement of the rib and the slot in the region of the intersection point of the longitudinal and transverse middle planes of the cover and the box, the cover can be displaced in opposite directions which insures that only objects, which are intended to be withdrawn, are actually withdrawn.

Providing two or more ribs on the upper edge of the longitudinally extending separation wall and a corresponding number of slots in the cover permits to manufacture package boxes with increased dimensions.

Polyproylen, because of its elastic characteristic and rigidity, proved to be a preferred material for manufacturing package boxes according to the present invention.

BRIEF DESCRIPTION OF THE DRAWINGS

The features and objects of the present invention will become more apparent, and the invention itself will be best understood from the following detailed description of the preferred embodiment when read with reference to the accompanying drawings, wherein.

DETAILED DESCRIPTION OF THE PREFERRED EMBODIMENT

Figure 1:
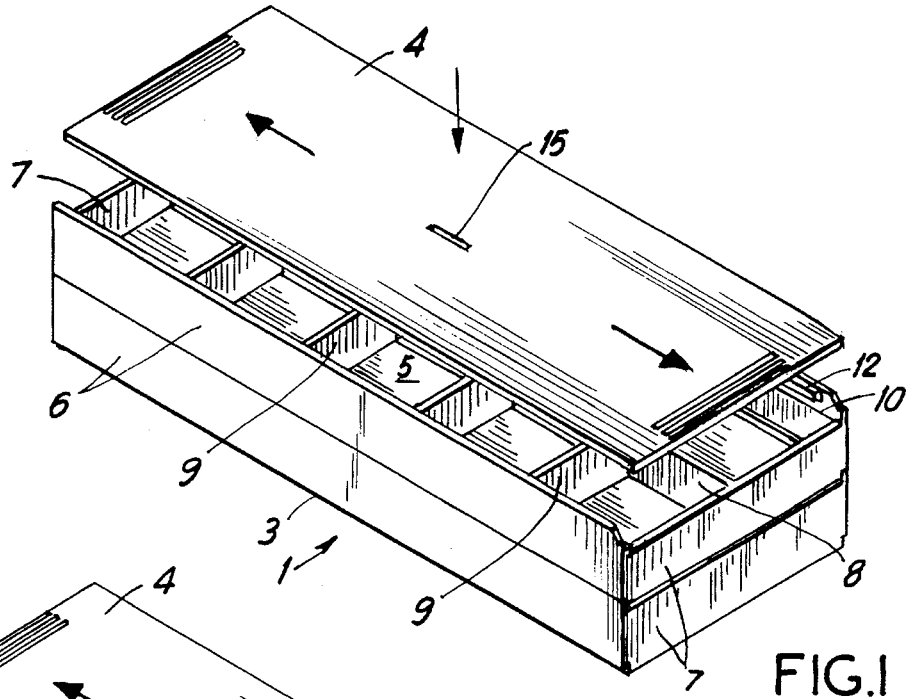
FIG. 1 is a perspective view of two package boxes according to the present invention seating on each other, with the cover of one box being withdrawn.

A plastic package box 1 for flat objects 2, e.g., cutting inserts, includes a main part 3 and a cover 4 as its essential components.

The box main part 3 has a form of a rectangular parallelepiped with a bottom 5, two longitudinal side walls 6, which extend perpendicular to the bottom 5, and two end walls 7, which likewise extend perpendicular to the bottom 5. The side and end walls define an upper opening which can be opened and closed with the cover 4 sliding in a longitudinal direction.

A separation wall 8 projects from the bottom 5 and extends along the entire length of the box in the longitudinal middle plane of the main part 3, and transverse separation walls 9, extending from the bottom 5, are located between the longitudinal wall 8 and longitudinal side walls 6. The separation walls 8 and 9 have a height D, which is smaller than the height of the side walls 6. The side walls 6 have, at the level of the upper edges of the separation walls 8 and 9, a guide bead 10 which extends substantially parallel to the bottom 5 and above which the edge region 11 of the side walls 6 has a reduced thickness in comparison with the side region beneath the guide beads 10, i.e., the guide bead 10 forms in each side wall 6 a step.

Each side wall 6 has, in its upper edge region 11, several steps 12 the lower surfaces 18 of which adjacent to the separation wall 9 or the guide bead 10 are spaced from the separation walls or the guide bead a distance which is substantially equal to the thickness H of the cover 4. Each side wall 6 has several of the steps 12 spaced from each other in the longitudinal direction.

The separation wall 8 has, on its upper edge in the region of intersection points of the longitudinal middle plane of the box 1 with the transverse middle plane of the box 1, a rib 13 extending in longitudinal direction, having a relatively small length, and the end edges 14 of which are equally spaced from both and walls 7. The height h of the rib 13 does not exceed the thickness H of the cover 4 and, preferably, constitutes about two-third of the cover thickness, as can be seen in FIGS. 3(*b*) and 6.

The cover 4 has in its longitudinal middle plane a slot 15, the dimensions and the location of which (the intersection region of the transverse and longitudinal middle planes of the cover) correspond to the rib 13 provided on the separation wall 8. The rib 13 is being received in the slot 15 and thereby prevents unintended longitudinal displacement of the cover 4, as shown in FIGS. 3(*b*) and 6.

Figure 2:
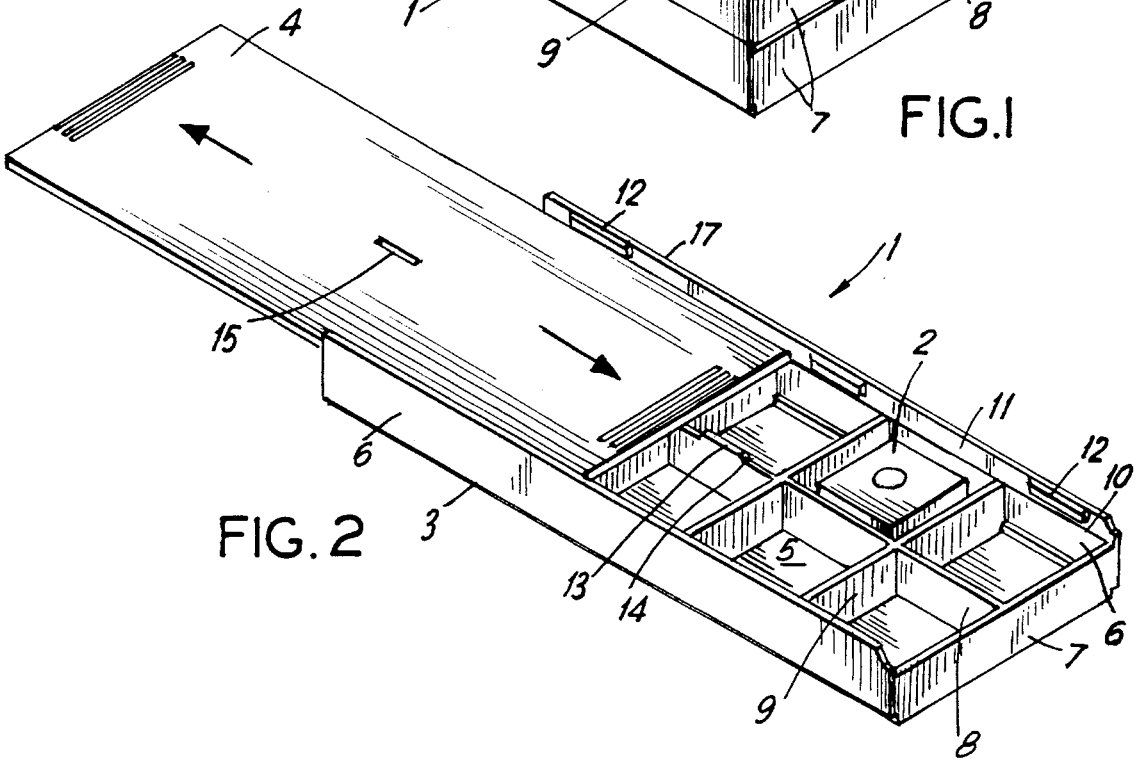
FIG. 2 is a perspective view of a package box with the cover being withdrawn.
Figure 3A:
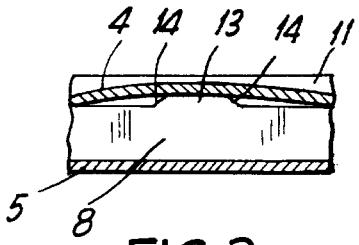
FIG. 3 is a longitudinal cross-sectional view of two different cover position strats (a) and (b) at an increased scale.
Figure 3B:
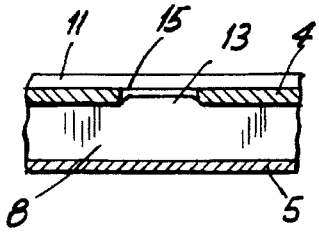
Figure 4:
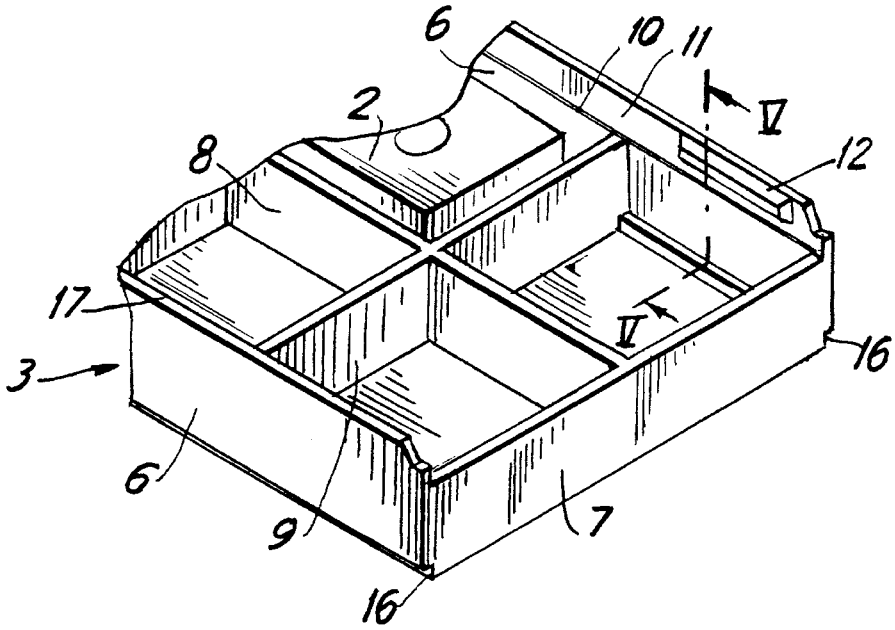
FIG. 4 is a perspective view of a portion of the box shown in FIG. 2 at an increased scale.
Figure 5:
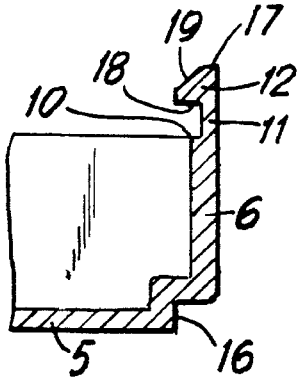
FIG. 5 is a broken perpendicular cross-sectional view along line V—V in FIG. 4.
Figure 6:
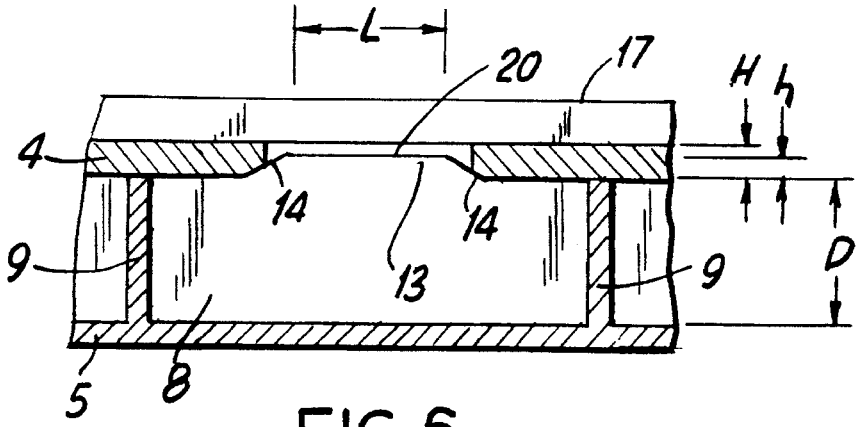
FIG. 6 is a view similar to that of FIG. 3 at an increased scale.

The cover 4, which has a relatively small thickness and is formed of flexible material, on one hand is subjected, during its displacement in the upward direction, to a pressure in the region of its middle plane, as shown in FIG. 3(*a*). However, on the other hand, the cover 4 is forcefully held in its edge regions with the steps 12, so that the cover 4 is subjected to a certain arching and tension resulting in that cover 4 can be displaced, along a portion of its inner surface which engages the rib 13, only when a force is applied. To increase this effect, one of the steps 12 on each side wall 6 is provided, as the rib 13, in the region of the transverse middle plane of the box 1, as shown in FIG. 2.

Advantageously, both end edges 14 of the rib 13 are inclined from their upper edge 20 toward the separation walls 9, whereby these end edges, during automatized placement of the cover 4, form guides therefor to insure exact predetermined positioning of the cover 4. On the other hand the inclination facilitate the displacement of the cover 4 along the rib 13, after an object 2 has been removed, for closing the box.

The length L of the rib 13 is substantially equal to the height D of the separation wall 8, 9. Such a dimension proved to be advantageous for achieving the effect contemplated by the provision of the rib 13.

In the same way, the upper surface 19 of the step 12 is also formed with an inclination to facilitate the insertion of the cover 4 into the box opening limited by the side walls 6.

The package box 1, shown in FIGS. 1 and 2, can be provided with two ribs 13 on the longitudinal separation wall 8 and with two slots 15 in the cover 4. This is contemplated for package boxes having large dimensions.

The preferred material for the package box is polypropylen.

As shown in FIGS. 1, 2, 4, and 5, flutes 16, webs, or the like can be provided on the lower surface of the box bottom for insuring engagement, e.g., with upper edges 17 of the side walls 6 of a below located box for stacking the boxes and retaining them in a stack.

Though the present invention was shown and described with reference to a preferred embodiment, various modification thereof will be apparent to those skilled in the art and, therefore, it is not intended that the invention be limited to the disclosed embodiment and/or details thereof, and departure can be made therefrom within the spirit and scope of the appended claims.

What is claimed is:

1. A package box formed of a plastic material for flat objects having relatively small dimensions, said package box comprising:

a box main part having a shape of a rectangular parallelepiped and including:

a bottom, two longitudinally extending sidewalls and two transversely extending end walls projecting upward from the bottom and defining an upper box opening, a longitudinally extending separation wall projecting upward from the bottom and extending in a longitudinal middle plane of the box main part along an entire length of the box, and a plurality of transversely extending separation walls projecting from the bottom and extending between the longitudinally extending separation wall and the longitudinally extending side walls; and a cover for closing the box opening displaceable in a longitudinal direction of the box and having an inner surface lying, in a closed condition of the box, on upper edges of the separation and end walls and on guide beads provided on the longitudinally extending side walls, and an outer surface located beneath a plane defined by the upper edges of the longitudinally extending side walls;

wherein the separation and end walls have a height smaller than a height of the side walls, wherein the side walls have steps projecting into the box opening and having surfaces facing the separation walls and spaced from the upper edges of the separation walls and the guide bead by a distance substantially equal to a thickness of the cover, wherein the upper edge of the longitudinally extending separation wall has at least one rib equally spaced from both end walls and having a height not exceeding a thickness of the cover, and wherein the cover has in a longitudinal middle plane thereof at least one slot corresponding to the rib for receiving the rib in the closed condition of the box.

2. A package box as set forth in claim 1, wherein the upper edge of the longitudinally extending separation wall has two ribs equally spaced from respective end walls, and the cover has two slots for receiving the two ribs in the closed condition of the box.

3. A package box as set forth in claim 2, wherein the rib has inclined end edges.

4. A package box as set forth in claim 2, wherein the rib has a length equal to the height of the separation walls.

5. A package box as set forth in claim 1, wherein the steps have surfaces inclined inward from their respective upper edges.

6. A package box as set forth in claim 1, wherein the height of the rib above the upper edge of the longitudinally extending separation wall is equal to two-third of the thickness of the cover.

7. A package box as set forth in claim 1, wherein the box is formed of a polypropylene.

* * * * *